US011298703B2

(12) United States Patent
Lutoslawski

(10) Patent No.: US 11,298,703 B2
(45) Date of Patent: Apr. 12, 2022

(54) MODULAR PULVERIZER

(71) Applicant: TORXX KINETIC PULVERIZER LIMITED, Hamilton (BM)

(72) Inventor: Jaroslaw Lutoslawski, Bradford (CA)

(73) Assignee: TORXX KINETIC PULVERIZER LIMITED, Hamilton (BM)

( * ) Notice: Subject to any disclaimer, the term of this patent is extended or adjusted under 35 U.S.C. 154(b) by 507 days.

(21) Appl. No.: 15/405,414

(22) Filed: Jan. 13, 2017

(65) Prior Publication Data

US 2019/0001337 A1 Jan. 3, 2019

Related U.S. Application Data

(60) Provisional application No. 62/278,089, filed on Jan. 13, 2016.

(51) Int. Cl.
*B02C 13/288* (2006.01)
*B02C 13/14* (2006.01)

(52) U.S. Cl.
CPC ..... *B02C 13/288* (2013.01); *B02C 13/14* (2013.01); *B02C 2201/06* (2013.01)

(58) Field of Classification Search
CPC ..... B02C 13/288; B02C 13/14; B02C 23/00; B02C 23/28; B02C 7/08
USPC ..... 241/30, 101.2, 55–56
See application file for complete search history.

(56) References Cited

U.S. PATENT DOCUMENTS

| | | | |
|---|---|---|---|
| 375 | A | 9/1837 | Smith |
| 7,000 | A | 1/1850 | Goshon |
| 56,672 | A | 7/1866 | Heneage |
| 125,172 | A | 4/1872 | Chichester |
| 134,513 | A | 1/1873 | Chichester |
| 248,923 | A | 11/1881 | Dechamp |
| 277,138 | A | 5/1883 | Knight |
| 441,372 | A | 11/1890 | Morse |
| 499,795 | A | 6/1893 | Morse |
| 964,102 | A | 7/1910 | Gordon |
| 1,048,869 | A | 12/1912 | Pitcairn |
| 1,178,386 | A | 4/1916 | Edwards |

(Continued)

FOREIGN PATENT DOCUMENTS

| | | | |
|---|---|---|---|
| CN | 103934085 | A | 7/2014 |
| CN | 105833944 | A | 8/2016 |

(Continued)

*Primary Examiner* — Nhat Chieu Q Do

(74) *Attorney, Agent, or Firm* — Brooks Kushman P.C.

(57) ABSTRACT

A pulverizer is provided having a top having an inlet and a bottom having an outlet. A modular drum has a drum housing wall with a plurality of planar panel portions extending between the top and the bottom and connected together. A drum liner is disposed inside the drum housing wall, the drum liner including a plurality drum liner portions to attached to the planar panel portions, each drum liner portion being at least partially planar and extending along a corresponding planar panel portion, each drum liner portion being detachable from the planar panel portion independently from the other drum liner portions. A rotating shaft is mounted within the modular drum and has radially extending arms creating flow currents within the pulverizer for reducing a size of product input fed into the inlet and producing a size reduced material that is discharged through the outlet.

15 Claims, 3 Drawing Sheets

(56) References Cited

U.S. PATENT DOCUMENTS 1,197,888 A 9/1916 Adams
1,212,418 A 1/1917 Sturtevant
1,212,419 A 1/1917 Sturtevant
1,300,192 A 4/1919 Overstrom
1,479,541 A * 1/1924 Hirsch ..... B02C 13/14 241/188.1
1,608,717 A 11/1926 Bell
1,636,033 A * 7/1927 Agnew ..... B02C 13/14 241/188.1
1,656,756 A 1/1928 Payne
1,669,239 A 5/1928 Grindle
1,758,010 A 5/1930 Pettinos
1,798,465 A 3/1931 Grindle
1,911,193 A 5/1933 Hill
1,935,344 A 11/1933 Andrews et al.
2,012,694 A 8/1935 Runyan
2,092,307 A 9/1937 Gaffney
2,093,703 A 9/1937 Blodgett
2,130,064 A 9/1938 Bucky
2,164,409 A 7/1939 Johnson
2,171,525 A 9/1939 Ainsa
2,248,927 A 7/1941 Ainsa
2,259,939 A 10/1941 Garcia
2,275,595 A 3/1942 Schwartz
2,355,784 A 8/1944 Dondlinger
2,367,906 A 1/1945 Wall et al.
2,392,958 A 1/1946 Tice
2,546,286 A 3/1951 Zakel
2,562,560 A 7/1951 MacArtney
2,592,994 A 4/1952 Ahlmann
2,595,117 A 4/1952 Ahlmann
2,639,747 A 5/1953 Burn et al.
2,700,512 A 1/1955 Denovan et al.
2,707,594 A 5/1955 Moore
2,709,552 A 5/1955 Lecher
2,713,977 A 7/1955 Noll
2,750,120 A 6/1956 Pallmann
2,847,168 A 8/1958 Smiley
2,917,248 A 12/1959 Krug et al.
2,919,864 A 1/1960 Parmele
2,937,815 A 5/1960 Eirich et al.
2,940,676 A 6/1960 Brake
2,981,489 A 4/1961 Hannum, Jr.
2,992,783 A 7/1961 Wirth et al.
3,015,392 A 1/1962 Rozsa et al.
3,062,459 A 11/1962 Dearing
3,065,919 A * 11/1962 Burkett ..... B02C 13/1814 241/47
3,071,330 A 1/1963 Jackering
3,123,115 A 3/1964 Howard
3,155,326 A 11/1964 Rhodes
3,160,354 A * 12/1964 Burkett ..... B01F 5/223 241/275
3,180,582 A 4/1965 Danyluke
3,207,447 A 9/1965 Whitham
3,210,016 A 10/1965 Sevin et al.
3,302,895 A 2/1967 Ryder
3,326,476 A 6/1967 De Los Santos
3,329,350 A 7/1967 Wisgerhof et al.
3,346,203 A 10/1967 Danyluke
3,381,904 A * 5/1968 Glidden ..... B02C 13/18 241/73
3,426,673 A 2/1969 Miner et al.
3,474,974 A 10/1969 Wood
3,490,704 A 1/1970 Bourne et al.
3,555,996 A 1/1971 Schwarz et al.
3,615,008 A 10/1971 Alpha
3,834,631 A 9/1974 King
3,873,034 A 3/1975 Iwahori et al.
3,887,141 A 6/1975 Francis
3,946,953 A 3/1976 Hato
3,976,002 A 8/1976 Gerlach
3,987,970 A 10/1976 Burkett
4,030,670 A 6/1977 Abernathy
4,098,466 A 7/1978 MacElvain et al.
4,144,167 A 3/1979 Burkett et al.
4,151,794 A 5/1979 Burkett
4,151,959 A 5/1979 Deister
4,202,078 A 5/1980 Malinak
4,493,459 A 1/1985 Burkett
4,531,461 A 7/1985 Sayler et al.
4,593,861 A 6/1986 Blakley et al.
4,637,561 A 1/1987 Edberg
4,690,338 A * 9/1987 Sayler ..... B02C 13/18 241/154
4,886,216 A 12/1989 Goble
4,989,796 A 2/1991 Eide
5,067,661 A 11/1991 Eide
5,184,781 A 2/1993 Andela
5,192,029 A * 3/1993 Harris ..... B02C 13/14 241/154
5,205,500 A 4/1993 Eide
5,285,973 A 2/1994 Goforth et al.
5,379,951 A 1/1995 Hughes
5,680,994 A * 10/1997 Eide ..... B02C 13/18 241/154
5,685,500 A 11/1997 Eide et al.
5,732,894 A * 3/1998 Sheahan ..... B02C 13/18 241/154
5,820,044 A * 10/1998 Greco ..... B02C 13/18 241/154
5,839,671 A 11/1998 Sand et al.
5,865,381 A * 2/1999 Mitsumura ..... B01J 2/006 241/18
6,024,307 A 2/2000 Sand et al.
6,135,370 A 10/2000 Arnold
6,179,231 B1 1/2001 Csendes
6,227,473 B1 5/2001 Arnold
6,726,133 B2 4/2004 Hahn et al.
7,950,601 B2 5/2011 Watts
8,020,791 B2 9/2011 Knueven et al.
8,267,337 B2 * 9/2012 Webb ..... B02C 13/18 241/27
8,678,306 B2 3/2014 Watts
8,931,721 B2 1/2015 Jensen et al.
9,192,940 B2 * 11/2015 Muther ..... B02C 13/18
9,205,431 B2 12/2015 Anderson
9,498,780 B2 11/2016 Watts et al.
9,707,564 B2 7/2017 Mogan et al.
9,751,087 B2 * 9/2017 Watts ..... B02C 13/288
10,799,873 B2 * 10/2020 Yunger ..... B02C 13/09
2006/0124787 A1 * 6/2006 Schweiger ..... B02C 13/284 241/89.3
2010/0327096 A1 * 12/2010 Watts ..... B02C 13/1814 241/56
2012/0119003 A1 * 5/2012 Watts ..... B02C 18/12 241/30
2015/0034747 A1 * 2/2015 Watts ..... B02C 13/288 241/55
2016/0144371 A1 * 5/2016 Sontag ..... B02C 13/282 241/56
2018/0015478 A1 * 1/2018 Yunger ..... B02C 13/282

FOREIGN PATENT DOCUMENTS

DE 102012104031 A1 * 11/2013 ..... B02C 13/30
EP 0202424 B1 8/1990
EP 0525362 B1 10/1994
WO 1989008752 A1 9/1989
WO 1993002797 A1 2/1993
WO 1998055234 A1 12/1998
WO 2008131477 A1 11/2008

* cited by examiner

MODULAR PULVERIZER

CLAIM OF PRIORITY

This application claims the benefit of U.S. Provisional Patent Application No. 62/278,089 filed Jan. 13, 2016, which is incorporated herein by reference in its entirety.

FIELD OF THE INVENTION

The present invention relates to a pulverizer also known as a vertical grinding mill which are normally provided with a rotating shaft with a plurality of arms spinning thereabout which generate a series of air currents inside of a cylinder to pulverize, aerate, homogenize and/or separate material.

BACKGROUND OF THE INVENTION

Solid materials such as garbage, rubbish or other solid materials have been collected by trucks and transported for disposal for many years.

Burkett developed a centrifugal mill sometime around in the mid-1970s and ended up with U.S. Pat. No. 3,987,970 and others. The applicant's predecessor-in-interest filed Canadian Patent Application Nos. 2,125,797 and 2,147,666 for use with various equipment and methods for pulverizing rock and remediating soil utilizing an improved pulverizer configuration. These three patents and patent applications are incorporated herein by reference in their entirety.

Still others have commercialized an embodiment of the Burkett mill and are trying to sell that design in the marketplace today. However, when attempting to build a Burkett mill with improvements, the applicant discovered there were components of that basic design which could be improved.

SUMMARY OF THE INVENTION

It is a present object of many embodiments of the present invention to provide an improved vertical gyroscopic mill or pulverizer having advanced capabilities.

It is another object of many embodiments of the present invention to provide a modular construction for a pulverizer mount so that the pulverizer can be made to be relatively simple in construction and fabrication characteristics to potentially reduce costs of the unit as well as to simplify the building and/or maintenance processes.

It is another object of the present invention to provide an ability to replace certain parts of a pulverizer drum without having to replace all the parts should some part fail or wear excessively.

Accordingly, in accordance with the presently preferred embodiment of the present invention, a modular pulverizer is provided. Specifically, instead of the housing being a rolled piece of metal of a sufficient thickness to withstand impacts from extremely rapidly rotating materials thrown around the body of the pulverizer, the body is instead divided into a series of modular segments or panels, and for many embodiments those panels can be interchangeable. Additionally, the panels can have lips which cooperate with lips of adjacent panels to provide a location for connecting adjacent panels together. Additionally, these lips can provide many secondary functions that may or may not be critical to the process.

Additionally, a series of drum liner attachments can be attached internally to the panels and/or housings of other embodiments so that should any of the drum liner panels be compromised or worn out, a single panel and/or individual panels could be swapped out with others without a need to replace the entire housing. These easily accessible liners can also be retained by the shelves or other internal components.

Additionally, a discharge from the pulverizer can be made as a single component so that panels can possibly be substantially identical above the discharge. In fact, one panel may hingedly connect to another for some embodiments so that the panel provides internal access.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
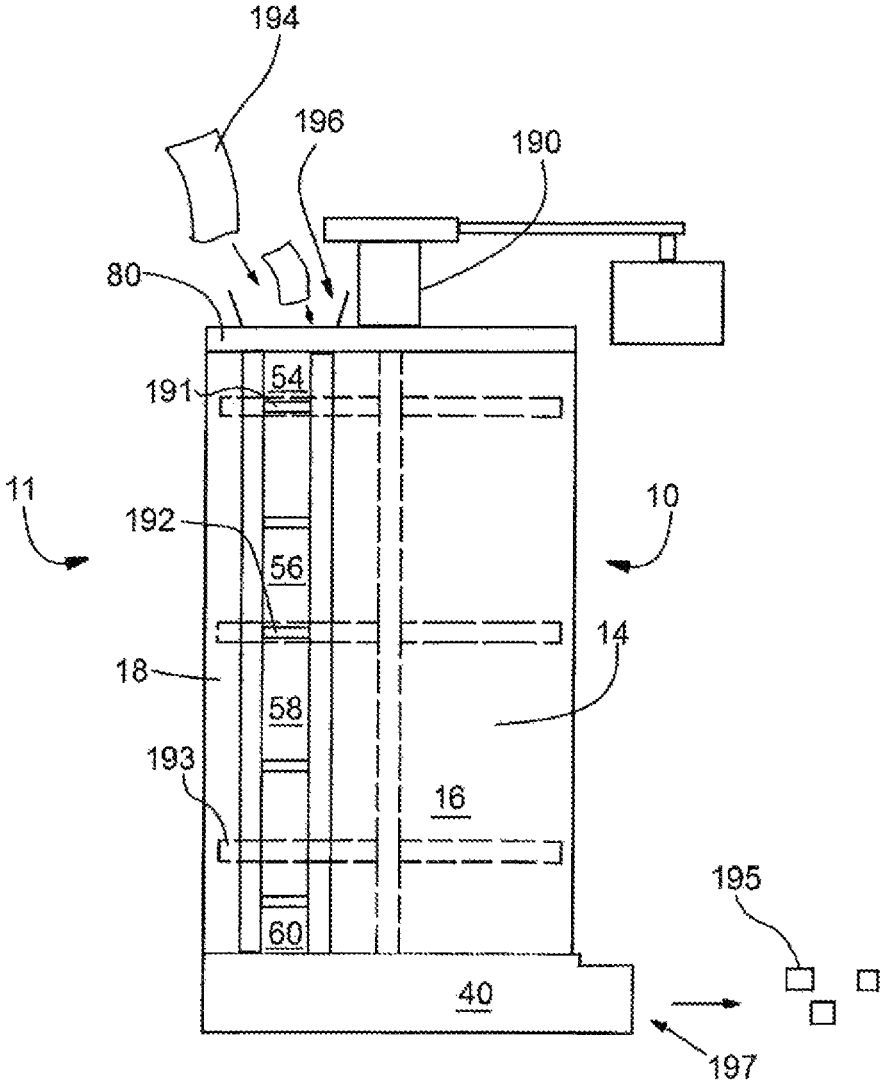
FIG. 1 is a pulverizer construction of the presently preferred embodiment of the present invention.

FIG. 1 shows a pulverizer 10 in accordance with one embodiment of the present application. The pulverizer may be constructed with a modular drum configuration. Specifically, a series of panels 12,14,16,18,20,22, many if not all of which may be similarly constructed, may be connected together with adjacent lips 24,26 to form a drum 11. Specifically, the first lip 24 may connect to a second lip 26 of an adjacent panel 22 either internally or externally relative to the inside of the drum 11. The panels 12-22 may have bores such as a series of bores 28,30 etc. to allow for a connection to be made. Bolts may connect many adjacent panels 12-22 or the lips 24,26 may be otherwise connected for many adjacent panels 12-22 such as by welding, etc. The bores 28,30 may also be used for other features as will be described in further detail below, and additionally, there may be external connectors which may connect at shoulders 32,34 to assist in connecting adjacent panels such as 16,18 as well as feet 36,38 which may also connect together, possibly to a bottom portion 40. The feet 36,38 can connect to discharge piece or bottom portion 40 such as at perimeter bores 42,44. Furthermore, perimeter bores 46,48 of bottom portion 40 may be useful to connect to perimeter bores 150,151 of the panels 12-22. A top can be similarly or dissimilarly connected.

In one embodiment, the panels 12-22 can be made similarly or even identically and so that the six panels 12-22 can come together to form a circumference about the perimeter 50 of the bottom portion 40. This way, the panels 12-22 need not be rolled after forming to a precise circumference. Instead, each of the panels 12-22 may have first and second portions 52,53 which may angularly meet together such as at about 30 degrees so that the six panels 12-22 can come together to form a complete circumference about the perimeter 50 of the bottom portion 40 so that no material escapes between the adjacent panels 12-22 during operation by connecting lips such as lips 24,26 to one another or alternatively either in a permanent manner such as by welding or using connectors such as through bores 28-30 and/or other connection. It may also be alternatively possible that at least one of the panels 12-22 is configured as a door relative to the other panels and may selectively lock in position during use in a locked configuration and then be able to be hingedly connected to an adjacent panel such as having panel 16 be hingedly connected to panel 14 while having the capability of locking the panel 18 during operation while also allowing the panel 16 to rotate open to an open configuration during periods of non-use as one of ordinary skill in the art would understand to perform service internal to the drum 11.

Lips 24,26 are shown extending at obtuse angles from the panel portions 52, 53, although the lips 24, 26 may extend at acute angles or be perpendicular to panel portions 52,53 and/or along radius of the drum (if thought of as round) and/or housing 61 to facilitate connection and/or construction.

Generally a consistent circumference about a large diameter cylindrical housing has been found to be expensive particularly when utilizing AR 400 or other metal. Few machine shops have been found to be willing to roll unitary drums to the desired shape. By providing the panel construction, the cost to form the housing or drum would significantly decrease.

Furthermore, by providing six separate panels 12-22 to provide a drum 11, possibly modular in nature, if any one of the panels 12-22 is damaged, they could simply be replaced without having to replace the entire housing. Furthermore, shipment of panels 12-22 as opposed to a unitary drum is generally easier as well. The amount of steel can be decreased and assembly is believed to be greatly improved in efficiency compared to other options. While six panels 12-22 are shown each having two portions, such as the planar portions 52,53. Other embodiments may have other numbers of panels 12-22, possibly with other numbers of portions 52-53 and/or meeting at other angles. Furthermore, not all panels 12-22 need necessarily be similarly constructed for all embodiments.

While AR 400 or other high strength metal can be utilized, the various improvements disclosed herein can provide a design providing more panels than the six panels 12-22 illustrated and still other improvements.

Additionally, while making a modular drum construction, it is further anticipated that drum liner attachments could be modular in nature for at least some embodiments.

Figure 2:
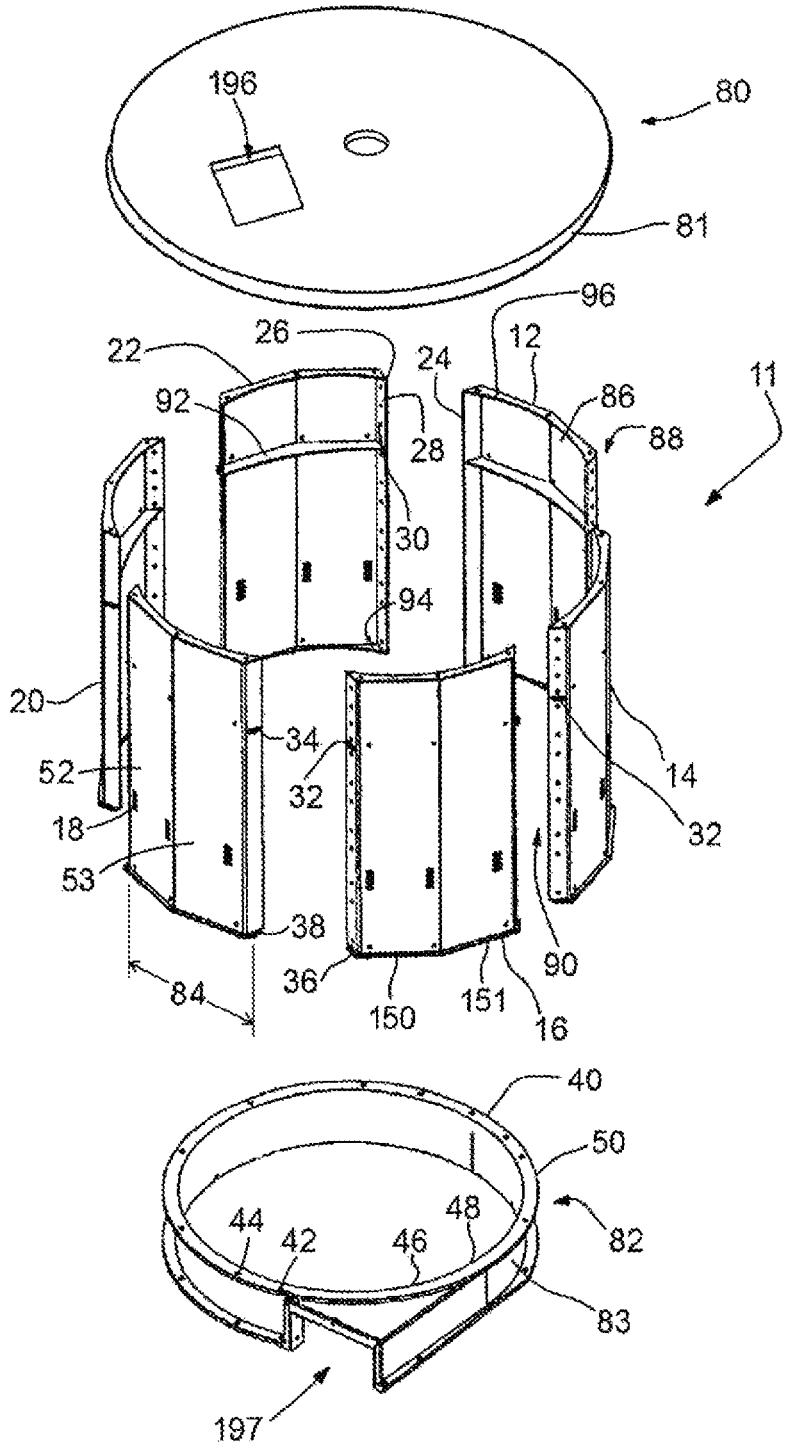
FIG. 2 is an exploded construction view showing the components of a pulverizer shown in FIG. 1.
Figure 3:
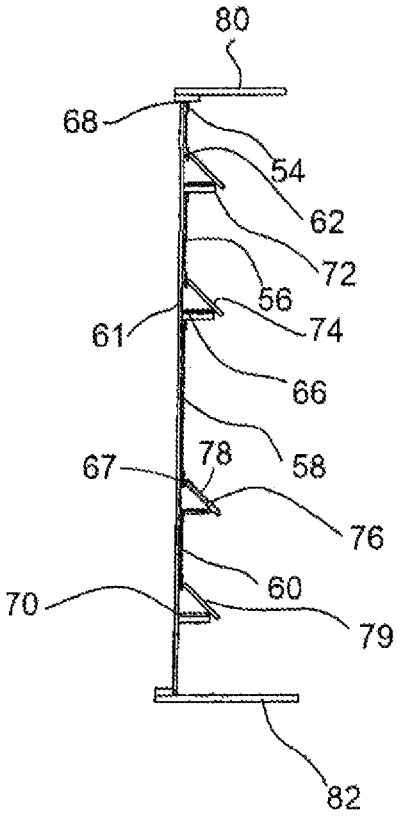
FIG. 3 is a cross-sectional view of a pulverizer drum with drum liner attachments as used with a presently preferred embodiment of the invention as shown in FIGS. 1 and 2.

FIG. 3 shows first, second, third and fourth drum liner attachment portions 54,56,58,60 forming a drum liner 59 which can be located against drum 11 or housing wall 61 i.e. along any of the panels 12-22 shown in FIG. 10 or against a drum or housing wall of any other pulverizer as is known in the art. Housing wall 61 may be curved (such as cylindrical) or angled (i.e. made of planar panel portions meeting at an angle) as described above or otherwise along insides of the drum 11. Specifically, the drum liner attachment portions 54-60 can have seams 62,66,67 as well as 68,70 which may be protected from contact such as by shelves 72,74,76 as well as guards 78,79 at the top 80 and bottom 82 respectively By providing a drum liner 59 in the form of portions such as the portions 54,56,58,60 it may be possible to test different materials other than just AR400 rolled steel as has traditionally been utilized as a drum housing wall 61 in the past. It may be that there is a low cost wear product whether a fiberglass, an HDPE high density polyethylene, a ceramic, some steels, chromium carbide overlays, ceramic overlays and/or other materials that may benefit from being utilized as any of the drum liner attachment portions 54-60 as would be understood by the reference to FIG. 3 and FIG. 2 if four portions 54,56,58,60 were utilized per panel, then a total of twenty-four total portions 54,56,58,60 (four times six) could then be utilized. Of course, the drum 11 could be less wear resistant than prior art designs (or not) and the liner(s) 59 could address impact internal to the drum 11 and/or address other concerns. Internal surfaces 55 of the drum liner 59 could be curved, like a cylinder or otherwise, or be planar regardless of the curvature or planar nature of the housing wall 61 depending upon the design objectives of the pulverizer 10.

Of course, other constructions could provide fewer or more portions 54-60. Utilizing the shelves 72,74,76 it has been found that they provide a particularly efficient way to cover over the seams 62,66,67 of adjacent portions as described above while other methods could connect in different ways. Additionally, the deflectors and/or shelves themselves may also be made in modular sets such as could be connected to each of the respective panels 12-22 such as in the form of portions 54-60 illustrated in FIG. 3 possibly only extending the width 84 of a single panel such as 18. Other portions 54-60 for other embodiments may be made to extend circumferentially about the entire drum. Other portions may extend vertically from top 80 to bottom 82 or anywhere in between.

Deflectors and/or shelves as shown in FIG. 1 may also be provided in modular form for at least some embodiments. The first and second planar portions 52,53 may be representative for each of the panels 12-22 or it may be that additional or fewer portions 52,53 would be provided for a respective panel. Portions 52,53 may be planar and connect with an interface such as at interface 86 which may define a consistent angle from a top 88 to a bottom 90 of the panel 12. Other embodiments could be constructed differently.

Furthermore, an intermediate lateral brace 92 could be provided for structural support and can be in addition to a bottom base 94 as well as an upper extension 96 for structural integrity of each of the panels 12-22. The brace 92, the bottom base 94 and the upper extension 96 are shown extending from lip to lip 24,26 of each panel, for at least some embodiments.

By constructing panels 12-22 and/or drum liner attachment portions 54-60 in such a way that the scalability can be increased, modularity can be made more efficient and the cost can be dropped to provide easier assembly for at least some embodiments.

Accordingly, a pulverizer 10 may comprise a top 80 having a perimeter 81, a bottom 82 having a perimeter 83, and a plurality of planar panel portions 52,53 connected together between the top 80 to the bottom 82 to provide a modular drum 11 construction. The pulverizer 10 also has a rotating shaft 190 having radially extending arms 191,192, 193 (or other numbers, at possibly the same or other elevations as better described by the patents/patent applications incorporated by reference herein) creating flow currents within the pulverizer 10 thereby reducing the size of product input 194 near the top and discharged at the bottom as output 195. Unlike prior art constructions, the panel portions 52,53 can be planar, and preferably modular, rather than being formed of a single cylindrically rolled drum, which can be rather expensive to produce.

The pulverizer 10 can connect the top 80 to the plurality of panel portions 52,53 as well the bottom 82. The top 80 can have an inlet 196 while the bottom has an outlet 197 whereby material to be pulverized is fed in the inlet 196 as input 194, broken into smaller pieces, and then discharged from the outlet 197 as output 195.

Panels 12,14,16,18,20,22 and/or others can have multiple panel portions 52,53, such as first and second panel portions 52,53. Some, many or even all of the panels 12-22 may be similarly constructed. The panels 12-22 can have feet 36,38 which connect to the bottom 82, such as with respective bores 150,151 etc. and 46,48, etc. in each receiving connectors therethrough, or otherwise. The panels 12-22 can have lips 24,26 whereby adjacent lips 24,26 may connect with one another to assist in forming the drum 11. The lips 24,26 may also have shoulders 32 which can provide connection locations on an external surface of the drum 11.

For some embodiments, at least one panel portion 52,53, if not a panel 12-22, forms the door as shown in FIG. 1 or otherwise by being hingedly connected to another panel portion 52 or 53 (if not another panel 12-22) and having a locked shut configuration and an open configuration as described above, or otherwise.

Internal to the drum 11 can be at least one drum liner 59, if not a plurality of drum liner portions 54-60. The drum liner 59 can meet the top 80 and bottom 82 at seams 68,70, and drum liner portions 54-60 can meet one another at seams 62,66,67. The seams 62,66,67,68,70 can be covered with at least one of shelves 72,74,76 and/or guards 78,79. Shelves 72,74,76 can assist in directing flow in the pulverizer 10.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A pulverizer comprising:

a top having an inlet;

a bottom discharge portion having an outlet offset from the top by a vertical distance;

a modular drum comprising:

a drum housing wall comprising a plurality of planar panel portions extending between the top and the bottom discharge portion and connected together; and a drum liner disposed inside the drum housing wall, the drum liner including a plurality of drum liner portions attached to the planar panel portions, the plurality of drum liner portions extending along a majority of the vertical distance of a corresponding planar panel portion, each drum liner portion being detachable from the planar panel portion independently from the other drum liner portions;

a rotating shaft mounted within the modular drum and having radially extending arms creating flow currents within the pulverizer for reducing a size of product input fed into the inlet and producing a size reduced material that is discharged at the outlet; and at least one shelf extending away from the drum housing wall and into a center of the drum, the at least one shelf being angled downwardly relative to a horizontal direction for directing flow inside the pulverizer, each shelf extending along a plane between an upper end connected to the drum housing wall and a lower end located away from the upper end wherein the bottom discharge portion is distinct from the modular drum and is secured thereto, the bottom discharge portion including a curved substantially annular inner surface defining a substantially cylindrical bottom cavity in communication with an interior of the modular drum, wherein the drum housing wall includes a plurality of panels, each panel including a first one of the planar panel portions and a second one of the planar panel portions disposed adjacent, and angled relative to, the first one of the planar panel portions, wherein each panel has lips, the lips of adjacent panels cooperating together to provide a location for connecting the adjacent panels together, wherein the lips extend inwardly into the modular drum at an obtuse angle respectively relative to the first and second ones of the planar panel portions.

2. The pulverizer of claim 1, wherein each shelf is disposed over a seam defined between adjacent ones of the drum liner portions to cover the seam.

3. The pulverizer of claim 1, wherein the drum liner portions are made of at least one of fiberglass, high-density polyethylene (HDPE) ceramic or steel.

4. The pulverizer of claim 1, wherein the drum liner portions include a chromium carbide overlay.

5. The pulverizer of claim 1, wherein the drum liner portions include a ceramic overlay.

6. The pulverizer of claim 1, wherein each planar panel portion includes feet connected to the bottom.

7. The pulverizer of claim 6, wherein the feet include a plurality of bores and the bottom includes corresponding bores, the bores of the feet and the bores of the bottom being configured for receiving connectors therethrough for connecting the feet to the bottom.

8. The pulverizer of claim 1, wherein the first one of the planar panel portions and the second one of the planar panel portions are angled relative to each other at an angle which is consistent between the top and the bottom.

9. The pulverizer of claim 8, wherein the first one of the planar panel portions and the second one of the planar panel portions are angled relative to each other at an angle of 30 degrees.

10. The pulverizer of claim 1, wherein at least some of the plurality of panels have a width being identical to each other.

11. The pulverizer of claim 1, wherein the lips have shoulders extending outside the modular drum to provide connection locations on an external surface of the drum.

12. A pulverizer comprising:

a top having an inlet;

a bottom discharge portion having an outlet offset from the top;

a modular drum having a plurality of drum panels each extending between the top and the bottom discharge portion and connected together along lateral sides to define a perimeter of the modular drum; and a drum liner disposed inside the modular drum and configured to protect the drum panels from impact, the drum liner including a plurality of drum liner portions separated in a vertical direction by seams, each drum liner portion being independently detachable from the other drum liner portions;

a plurality of shelves, wherein at least one shelf covers each seam, each one of the at least one shelf connected to the modular drum along an upper end and extending downwardly relative to a horizontal direction into the drum for directing flow inside the pulverizer; and a rotating shaft mounted within the modular drum and having radially extending arms creating flow currents within the pulverizer for reducing a size of product input fed into the inlet and producing a size reduced material that is discharged at the outlet, wherein the bottom discharge portion is distinct from the modular drum and is secured thereto, the bottom discharge portion including a curved substantially annular inner surface defining a substantially cylindrical bottom cavity in communication with an interior of the modular drum, wherein the plurality of drum panels each including a first planar panel portion and a second planar panel portion disposed adjacent, and angled relative to, the first the planar panel portion, wherein each drum panel has lips, the lips of adjacent drum panels cooperating together to provide a location for connecting the adjacent drum panels together, wherein the lips extend inwardly into the modular drum at an obtuse angle respectively relative to the first and second planar panel portions.

13. The pulverizer of claim 12, wherein the plurality of drum liner portions and the plurality of shelves cover a majority of a vertical distance between the top and the bottom.

14. A pulverizer comprising:

a top having an inlet;

a bottom discharge portion having an outlet offset from the top in a vertical direction;

a plurality of modular drum panels each extending between the top and the bottom discharge portion and connected together along lateral sides to define a circumference of a pulverizing chamber along inner walls; and a plurality of drum liner portions attached to the inner walls of the plurality of modular drum panels and configured to protect the drum panels from impact, each of the plurality of drum liner portions being independently detachable, the plurality of drum liner portions being separated in the vertical direction by seams;

a plurality of shelves each connected to the inner walls of the plurality of modular drum panels and extending downwardly relative to a horizontal direction into the pulverizing chamber for directing flow inside the pulverizer, wherein at least one shelf covers each seam between the drum liner portions; and a rotating shaft mounted within the modular drum and having radially extending arms creating flow currents within the pulverizer for reducing a size of product input fed into the inlet and producing a size reduced material that is discharged at the outlet, wherein the bottom discharge portion is distinct from the modular drum and is secured thereto, the bottom discharge portion including a curved substantially annular inner surface defining a substantially cylindrical bottom cavity in communication with the pulverizing chamber defined by the modular drum panels, wherein the plurality of drum panels each including a first planar panel portion and a second planar panel portion disposed adjacent, and angled relative to, the first the planar panel portion, wherein each drum panel has lips, the lips of adjacent drum panels cooperating together to provide a location for connecting the adjacent drum panels together, wherein the lips extend inwardly into the modular drum at an obtuse angle respectively relative to the first and second planar panel portions.

15. The pulverizer of claim 14, wherein the plurality of drum liner portions and the plurality of shelves cover a majority of a vertical distance between the top and the bottom.

* * * * *